United States Patent [19]

Blum

[11] Patent Number: 4,640,560

[45] Date of Patent: Feb. 3, 1987

[54] PILL DISPENSER

[76] Inventor: Richard S. Blum, 25 Spruce Dr., East Hills, N.Y. 11576

[21] Appl. No.: 682,658

[22] Filed: Dec. 17, 1984

[51] Int. Cl.[4] ..... G08B 21/00

[52] U.S. Cl. ..... 312/234.1; 312/234; 116/72; 116/308

[58] Field of Search ..... 312/234, 234.2, 234.1, 312/234.3, 122, 118; 220/306, 339; 116/72, 308; 40/107; 340/706

[56] References Cited

U.S. PATENT DOCUMENTS

| | | | |
|---|---|---|---|
| 556,520 | 3/1896 | Van Denbergh | 312/118 |
| 2,668,746 | 2/1954 | Weiskopf | 312/234.5 |
| 2,964,370 | 12/1960 | Butler | 312/234 |
| 3,744,867 | 7/1973 | Shaw | 312/234 |
| 3,872,996 | 3/1975 | Dogliotti | 220/339 |
| 4,253,572 | 3/1981 | Halbich | 220/306 |
| 4,501,456 | 2/1985 | Schafer | 312/348 |

*Primary Examiner*—Kenneth Dorner
*Assistant Examiner*—Joseph Falk
*Attorney, Agent, or Firm*—Helfgott & Karas

[57] ABSTRACT

A pill dispenser for dispensing daily medications prestored for a week. The dispenser includes an upright housing having a front and rear surface on each of which are contained a plurality of compartments arranged in rows and columns. Each column represents a day of the week and each row represents an hourly part of the day. A corresponding plurality of pillboxes are provided. Each pillbox can be slidably received within a respective compartment. Each pillbox have a hinged cover on it. Each pillbox stores all the medications to be taken at a particular hour and day corresponding to the particular compartment in which it is inserted. The pillboxes are restrained in their compartments but can be removed for transportability.

14 Claims, 4 Drawing Figures

PILL DISPENSER

BACKGROUND OF THE INVENTION

This invention relates to pill dispensers, and more particularly to a pill dispenser for dispensing daily medication prestored for a week's period.

Many people, especially the elderly, are required to take daily medication. In most situations, the daily medication is prescribed for various times of the day such as morning, afternoon and bedtime. At each of these times, there may be more than one pill or tablet to be taken, and frequently there may be a variety of assorted medicines at each particular time period.

Many individuals, especially the elderly, get confused over the various types of medicines required to be taken at particular times. This can be especially confusing when each of the medicines are placed in a bottle and many of the bottles or containers are of similar color or shape. It becomes difficult to know exactly which medicines to take at specific times and such confusion can often result in dangerous results if medicines are taken at the wrong time or erroneous combinations of medicines are taken.

Another problem, especially with the elderly, is that they are often forgetful and therefore do not always remember if particular medicines were taken at prescribed times. Although the patient may be reminded about taking the medicine, after the prescribed time has passed the patient may be unaware whether the medication has actually been taken.

Of course, when a patient is under constant supervision, such as in a hospital or with round the clock nurses, the patient can be continuously observed and the medication be given individually. However, there has been continuous encouragement for patients to remain in their own homes with occasional visits by nurses or members of the social service to check up on the individual's well being. In such situations there is required some sort of apparatus which can assist the patient in knowing the proper medication to be taken and the appropriate times.

This problem also exists in nursing homes. Although there is regular visits and supervision by nursing home personnel, nevertheless the patients are substantially on their own and are often required to take medications in accordance with prescribed times of the day. It becomes a difficult situation to continuously send personnel each time medication must be taken in order to be sure that the patient properly takes such prescriptions.

Although there have been numerous suggestions for apparatus which will give reminders to patients as to appropriate pills to be taken, such apparatus have generally been most complex and difficult to manipulate. If the apparatus becomes overly difficult, the patient may not be able to manage the device and, accordingly, will avoid trying to get the medicine at the appropriate time.

Additionally, although there may be devices to provide reminders to the patient, there must be a way of checking that the patient has actually taken the medicine. Simply providing the pills in a dispenser and relying upon the patient to take it does not provide sufficient information to a nurse or social service worker that the medicine has actually been taken.

An additional problem with prior art dispensers is that the dispenser is generally one that is fixed at a particular location. While this may be satisfactory to those patients that cannot travel on their own, many individuals would like the freedom to be able to leave their premises and at the same time have the required medicines available to them. In prior art devices, each time a medication had to be taken it required the patient to return to his own premises in order to operate the dispenser so as to give him the pills required for that time of day.

SUMMARY OF THE INVENTION

Accordingly, it is an object of the present invention to provide a pill dispenser which avoids the aforementioned problems of prior art devices.

Another object of the present invention is to provide a pill dispenser which can dispense daily medication prestored for a week's period.

Another object of the present invention is to provide a pill dispenser which can provide storage of an assortment of pills to be taken at a given hour within a day.

A further object of the present invention is to provide a pill dispenser which retains prestored medication for a week with all the appropriate medication of a given hour stored in a single compartment.

A further object of the present invention is to provide a pill dispenser which includes prestored medicines for a week and which includes a number of individual pillboxes which can be individually removed and transported by the patient.

Another object of the present invention is to provide easy and sure dispensing to the blind and physically handicapped.

Yet a further object of the present invention is to have the ability to assign compartments so that medication can be taken on an "as needed" basis for such illmess as heart problems, or for pain, etc.

Briefly, in accordance with the present invention there is provided a pill dispenser which dispenses daily medications prestored for a week period. This dispenser includes an upright housing having a plurality of compartments arranged in rows and columns. Each of the columns represents a day of the week and each row represents an hourly part of the day. A corresponding plurality of pillboxes are provided. Each of the pillboxes can be slidably received within a respective compartment. At the same time, the pillboxes can be removed for transportablilty. Each pillbox comprises an enclosed container having a hinged cover and stores all of the medications to be taken at a particular hour and day corresponding to the position of the compartment in which that pillbox is inserted. A restraining mechanism is provided so that they can be easily slid within the receptacles but held from easy removal. Nevertheless, when desired, each individual pillbox can still be removed from the compartment.

In an embodiment of the invention, a circuit is included in the housing. The circuit includes a clock which permits assigning a specific hour and day to each of the pillboxes in the housing. Appropriate indicators, such as lights, are provided on each pillbox. Each pillbox can be locked in position in the housing. When the appropriate time and day of a particular pillbox is reached, the indicator goes on and the latch on the pillbox is released. The indicator remains on until the pillbox has been removed. Once the pillbox is removed and the pills presumably taken, the pillbox can then be restored.

If desired, an additional audible alarm can be provided which will also remain on until the pillbox has been removed.

With the aforementioned pill dispenser, a nurse or social service worker can weekly prefill the dispenser with all of the assorted medicines needed by a particular patient. The patient can then be left on his own to take the appropriate medication. The nurse or social worker can always check whether particular medicines were taken by looking to see if the pills are still in the individual pillboxes, or if they have been removed.

At the same time, the patient can actually take one or more of the pillboxes with them should they leave the premises and in that way have all the medicines they need for a particular hour.

BRIEF DESCRIPTION OF THE DRAWINGS

In the drawing.

In the various figures of the drawing, like reference characters designate like parts.

DESCRIPTION OF THE PREFERRED EMBODIMENTS

Figure 1:
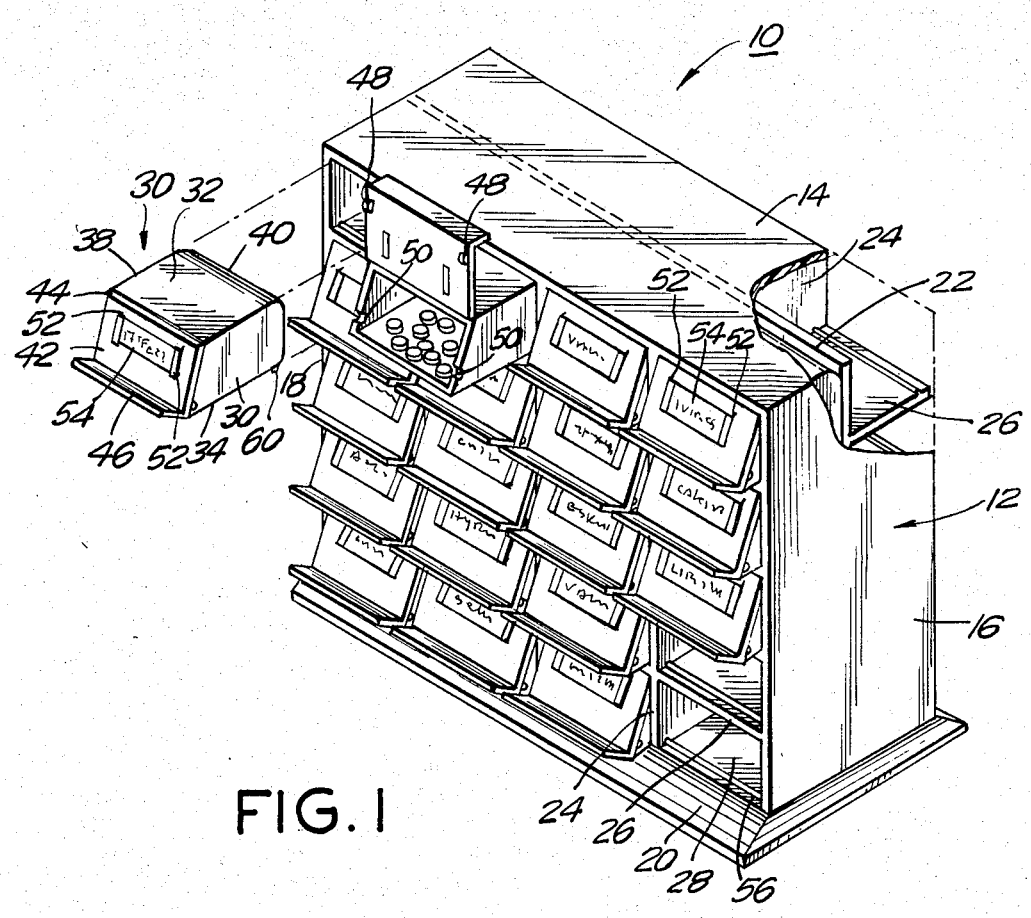
FIG. 1 is a perspective view of the pill dispenser of the present invention showing the individual pillboxes, at least one of which has been removed from the dispenser.
Figure 2:
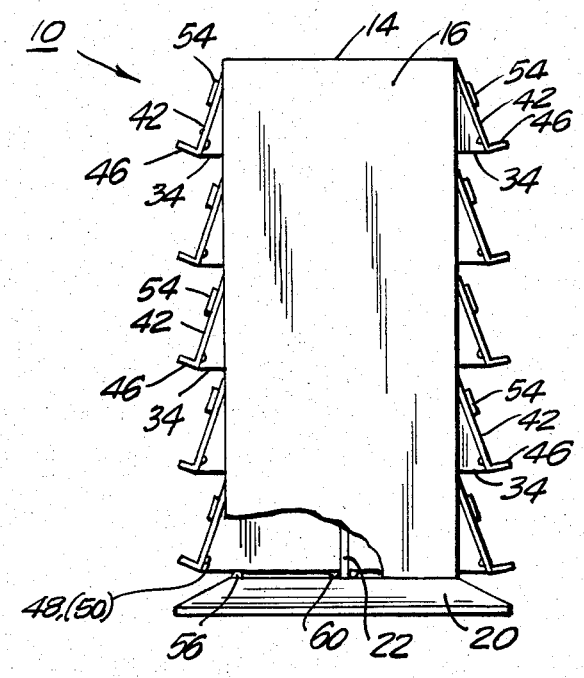
FIG. 2 is a side view, partially cut away, of the pill dispenser shown in FIG. 1.

Referring now to FIGS. 1 and 2, the present invention describes a pill dispenser shown generally at 10 and including a substantially rectangular housing 12 having a top wall 14, opposing side walls 16, 18, and a flared based pedestal 20. Interior of the housing there is provided a separating wall 22 which divides the housing substantially in half into a pair of opposing substantially identical configurations.

On each side of the wall 22, there are provided orthogonal vertical walls 24 and horizontal walls 26. The vertical walls 24 and horizontal walls 26 each define individual compartments 28 which are substantially rectangular in configuration.

Each of the receiving compartments 28 are so positioned so as to define a series of columns and rows. As shown, there are four columns on each side of the housing and five rows in each column.

The columns, totaling eight, are divided so that seven of the columns represent days of the week with one extra column provided for additional "as necessary" medicines which are taken without specific times assigned to them. Each of the five rows can be assigned to different parts of the day such as morning, noon, afternoon, evening, and bedtime. Alternately, the rows can be assigned to specific hours of the day such as when medicines are prescribed for every two or three hour intervals, or 6–8 hour intervals.

In each of the receiving compartments 28, there is inserted an individual pillbox, shown generally at 30. Each pillbox is a separate individual container having its own top wall 32, bottom wall 34, opposing side walls 36, 38 and rear wall 40. The front wall includes a cover 42 which is connected to the top wall 32 by means of an integral hinge 44.

The bottom wall 34 extends forward of the top wall 32 and the opposing side walls 36, 38 have their forward edge downwardly angled in a forward direction. In this way, the cover 42 is angled so that its lower portion extends forward more than its upper portion.

An upwardly turned lower ledge 46 is provided in order to facilitate grasping of the cover and raising it. In order to retain the cover in place, a pair of detents or protrusions 48 are provided which engage into corresponding notches 50 provided in the side walls 36, 38 of the pillbox. This will keep the cover in place in a closed position until raised by means of the ledge 46.

In order to identify the particular hour and day of each pillbox, there are provided a pair of projecting channels 52, 54 on the front of each pillbox in which can be inserted an appropriate marker or card 54. The marker or card 54 can be made erasable or alternately can be replaced to be able to write the proper time for each pillbox.

In order to retain each pillbox into its respective receiving compartment, an upwardly projecting lip 56 is provided along the bottom of each receiving compartment 28. A downwardly depending rib 60 is provided at the rear edge of the bottom wall 34 of each pillbox. In this manner, as the pillbox is slid forward within its receiving compartment, the rib 60 will engage the lip 56 and restrain pulling out of the pillbox from its respective receiving compartment.

Nevertheless, should it be desired to extract the pillbox completely from the housing, the pillbox can be strongly pulled forward overcoming the restraint so that the pillbox can be removed and transported by the patient, as shown by the extracted pillbox in FIG. 1.

With the embodiment shown in FIGS. 1 and 2, it is possible for a nurse or social worker to fill each of the pillboxes with the respective assortment of pills required for a particular hour of each day of the week. The pill dispenser can be filled for an entire week at one time. Additionally, "as necessary" medicine can also be included in a separate column. Each of the pillboxes is marked for a specific time and day and the pill dispenser set up at an appropriate location on the premises of the patient.

The patient can then pull out the appropriate pillbox at the particular time and day and take all of the medicine in the pillbox. The pillbox is then slid back into its location. Should the patient want to take the pillbox with him, the patient simply pulls the pillbox out of the dispenser and transports it with him.

At various times, the nurse or social worker can check if the pills were taken by examining the particular pillbox assigned to a particular hour and day. If the pills were removed, it is presumed that the pills were appropriately taken. However, if the pills are still in the pillbox, it is known that the patient neglected to take the prescribed medicine at the particular time.

Figure 3:
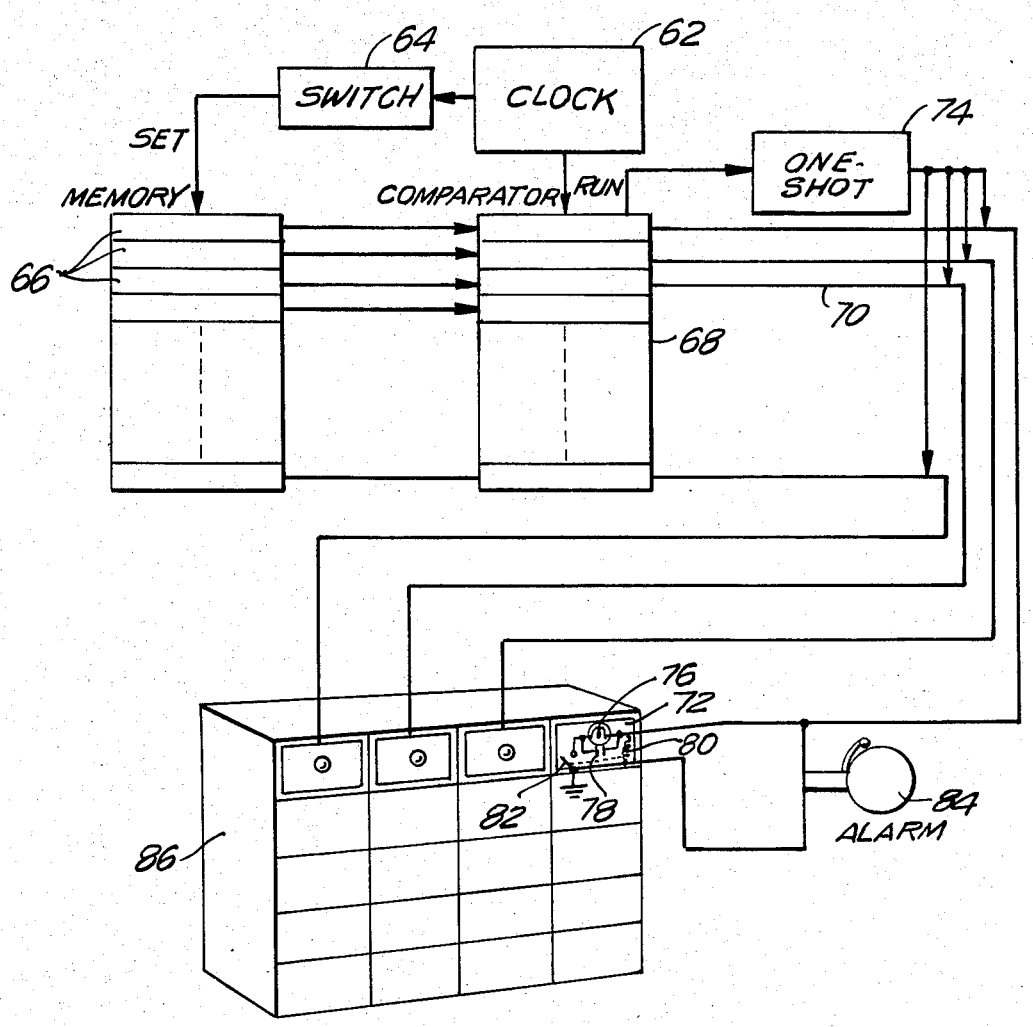
FIG. 3 is a schematic circuit diagram of an alternate embodiment of the pillbox including a circuit for providing an indication of which pillbox should be used.

Referring now to FIG. 3, there can be provided additional indication to the patient when appropriate times occur for individual pills to be taken. As shown, there is included in the apparatus a clock 62. The clock is used both for counting the current time as well as for setting the time on each individual pillbox. The switch 64 is used for the purpose of setting the times. When appropriately switched, the clock will be used to set individual times in each of the memory locations 66 provided for each of the respective pillboxes. Once each appropriate clock time is set for each pillbox, the switch 64 is adjusted so that the clock will then be used in its run mode.

During its run mode, the comparator 68 provides individual comparisons with the preset times in the memory 66. When an appropriate comparison occurs indicating that the time of a particular pillbox has been reached, an output occurs on line 70 which is sent to the appropriate one of the pillboxes, for example pillbox 72. At the same time, a signal is sent to the one shot multivibrator 74. In this manner, a pulse is sent to the particular pillbox circuit. This pulse serves to energize an indicator 76 such as a light bulb actually positioned on each of the respective pillboxes.

At the same time, a capacitor 78 in series with the circuit retains the light bulb energized. In this way, when a time occurs associated with a particular pillbox, that indicator will turn on and a light will remain on.

There can also be included an electro-magnetic relay 80 which operates the switch 82. The relay is initially energized so that the switch 82 is closed. This can be a locking switch which prevents removal of the pillbox until the appropriate time is reached. Once the appropriate time is reached, light bulb 76 turns on and remains on until the drawer is removed. Turning on of the light bulb at the same time releases the electro-magnetic relay permitting the drawer to be removed. After the drawer has been removed, switch 82 is opened so that upon returning the drawer into its position, the indicator will be turned off.

In order to provide an audible sound, an alarm 84 can also be included in parallel with all the indicator bulbs 76. Each time any one of the indicator bulbs turns on, the audible alarm will sound calling attention to the patient that he should go to the pill dispenser and see which indicator is lit and then extract that pillbox.

The pillboxes can be constructed with individual plugs so that they are connected to the circuit when they are inserted in the pill dispenser 86. However, they permit extraction for portability, as heretofore described.

Figure 4:
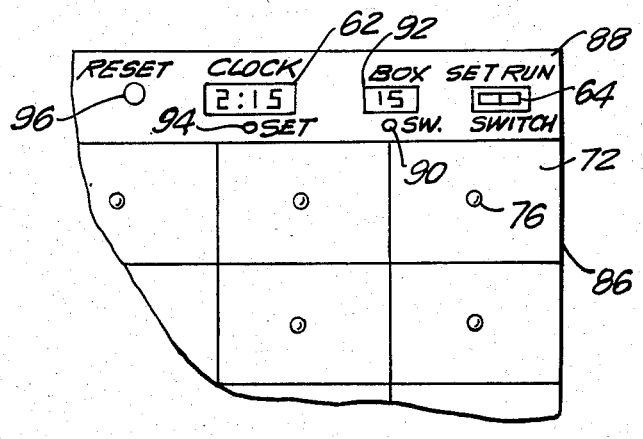
FIG. 4 is an exploded fragmentary view of a control panel for use with the pill dispenser of FIG. 3.

As shown in FIG. 4, a common panel 88 can be provided on the dispenser 86 which includes all of the various switches. For example, an appropriate switch 90 can be provided for use in setting each of the individual boxes, with the particular box number shown in the indicator 92. This can be used for setting each individual pillbox. A separate switch 94 can be provided for setting the clock to the correct time. Also, a reset switch 96 can be provided in order to reset all of the pillboxes to initialize them.

With the device shown in FIGS. 3 and 4, an appropriate nurse or social worker can initially set all of the medicines in place in each individual pillbox. Each pillbox is set with the appropriate time. The device is then turned back to its run mode. As each time of the respective pillboxes is reached, the audible alarm will go off and at the same time the proper indicator bulb on that pillbox will turn on. The alarm and the indicator will remain on until the pillbox is opened at which time the alarm and the indicator bulb will turn off. The pillboxes can be latched in place so that they cannot be extracted until the indicator goes off indicating the proper time for that medication to be taken.

There has been disclosed heretofore the best embodiment of the invention presently contemplated. However, it is to be understood that various changes and modifications may be made thereto without departing from the spirit of the invention.

I claim:

1. A pill dispenser for dispensing daily medications pre-stored for a week comprising:

an upright housing having a plurality of compartments arranged in rows and columns, each column representing a day of the week and each row representing an hourly part of the day;

a corresponding plurality of pill boxes, each slidably receivable within a respective compartment, each pill box respectively comprising an enclosed container having a hinged cover and storing all the medications to be taken at a pre-set hour and day;

means for retaining said pill boxes in their respective compartments;

clock means for pre-setting a day and hour for each pill box;

indicator means associated with each pill box and coupled to said clock means whereby the indicator means on a respective pill box will give an appropriate indication when the time and day pre-set for that pill box occurs;

circuit means for retaining the indication until the pill box has been removed, and means to turn off the indicator means after the pill box has been removed.

2. A pill dispenser as in claim 1, wherein each pillbox comprises interconnected top, bottom, rear, and side walls to form an enclosed container, a opening front door, and an integral hinge along the junction edge between said top wall and said front door.

3. A pill dispenser as in claim 2, wherein said bottom wall extends forwardly of said top wall and the forward edges of said side walls are downwardly angled in a forward direction, whereby said front door is angularly oriented such that its top edge is rearward of its bottom edge.

4. A pill dispenser as in claim 2, and comprising a rib depending from said bottom wall, and a mating lip upwardly extending along the bottom edge of each of said compartments for engaging the rib of the pillbox correspondingly inserted therein, to thereby restrain accidental removal of the pillbox from the compartment.

5. A pill dispenser as in claim 4, wherein said libs extend transversely across a forward edge of said compartment, and said ribs extend transversely across a rear edge of said bottom wall whereby said pillboxes can be slidably pulled forward within their respective compartments.

6. A pill dispenser as in claim 2, and comprising an upturned ledge at the lower distal edge of said front door to facilitate grasping of the door.

7. A pill dispenser as in claim 2, comprising removable indentification means on the exterior of said front door to indicate the hour and day of the respective pillbox.

8. A pill dispenser as in claim 7, wherein said identification means comprise a pair of opposed vertical channels projecting from the exterior of said front door, and a marking sheet slidably insertable within said channels.

9. A pill dispenser as in claim 1, wherein said housing comprises a rectangular configuration having a front and rear surface, and wherein said receptacles are arranged on both the front and rear surfaces thereof.

10. A pill dispenser as in claim 7, wherein said identification means is in braille.

11. A pill dispenser as in claim 9, and comprising four columns and five rows of receptacles on each of said front and rear surfaces, seven columns representing days of the week and the eighth column for general type medicines.

12. A pill dispenser as in claim 1, and further comprising latch means for retaining all the pillboxes secured within their respective compartments until the corresponding time and day is reached.

13. A pill dispenser as in claim 1, wherein said indicator means comprise a light on each pillbox, the light on a pillbox illuminating when its corresponding day and time is reached.

14. A pill dispenser as in claim 13, and further comprising an audible alarm, said alarm sounding when any light is illuminated.

* * * * *